United States Patent [19]

Bean et al.

[11] Patent Number: 4,572,647

[45] Date of Patent: Feb. 25, 1986

[54] HYBRID DEVELOPMENT SYSTEM

[75] Inventors: Lloyd F. Bean, Rochester; Roger L. Miller, Penfield, both of N.Y.

[73] Assignee: Xerox Corporation, Stamford, Conn.

[21] Appl. No.: 554,519

[22] Filed: Nov. 23, 1983

[51] Int. Cl.[4] ..... G03G 15/00

[52] U.S. Cl. ..... 355/3 R; 355/3 DD; 430/31; 430/122

[58] Field of Search ..... 355/3 R, 3 DD, 4; 118/645, 653; 430/31, 42, 45, 120, 122

[56] References Cited

U.S. PATENT DOCUMENTS 4,124,287 11/1978 Bean et al. ..... 355/3 DD X
4,227,795 10/1980 Bobbe et al. ..... 355/4 X
4,239,845 12/1980 Tanaka et al. ..... 430/122
4,256,820 3/1981 Landa ..... 355/3 R X
4,289,837 9/1981 Gundlach ..... 355/3 DD X
4,509,850 4/1985 Weigl ..... 355/4

*Primary Examiner*—R. L. Moses
*Assistant Examiner*—J. Pendegrass
*Attorney, Agent, or Firm*—H. Fleischer; J. E. Beck; R. Zibelli

[57] ABSTRACT

An electrophotographic printing machine in which a latent image is recorded on a photoconductive surface. The latent image is developed with charged, insulating marking particles and magnetic, polar or polarizable marking particles. The charged, insulating marking particles optimize development of low density lines in the latent image with the magnetic, polar or polarizable marking particles optimizing development of halftones in the latent image.

12 Claims, 3 Drawing Figures

HYBRID DEVELOPMENT SYSTEM

This invention relates generally to an electrophotographic printing machine, and more particularly concerns a hybrid development system used in the printing machine.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer mixture is transported into contact with the electrostatic latent image. Toner particles are attracted from the carrier granules of the developer mixture onto the latent image. The resultant toner powder image is then transferred from the photoconductive surface to a copy sheet and permanently affixed thereto.

Hereinbefore, the electrostatic latent image recorded on the photoconductive surface was developed by a magnetic brush development system. In a magnetic brush development system, a magnetic member attracts a developer material to the exterior circumferential surface of a rotating sleeve. As the sleeve rotates, the developer material is transported into a development zone closely adjacent to the latent image. The latent image attracts the toner particles from the carrier granules. Generally, the developer material is either electrically conductive or electrically insulating. An insulating developer material provides excellent low density line development. However, the solid areas and halftones are not developed in an optimal fashion. In contradistinction, a conductive developer material optimumly develops solid areas and halftones with low density lines not being developed in an optimal fashion. Various attempts have been made to combine both insulating and conductive developer materials in a magnetic brush development system. However, it has been found that the toner particles deposited on the latent image by the first magnetic brush are subsequently removed therefrom by the second magnetic brush. Thus, if the first magnetic brush used a conductive developer material and the second magnetic brush an insulating developer material, the toner particles developed on the latent image by the first magnetic brush were subsequently removed therefrom by the second magnetic brush. Hence, a true additive development process was feasible. Various approaches have been devised to overcome the foregoing problem. The following disclosure appears to be relevant: Co-Pending U.S. application Ser. No. 520,971, Applicant: Weigl, Filed: Aug. 4, 1983.

The relevant portions of the above-identified disclosure may be briefly summarized as follows:

Weigl discloses an electrophotographic printing machine in which modulated regions of a latent image are developed with polar or polarizable marking particles with the continuously charged regions thereof being developed with charged marking particles. The charged marking particles and the polar or polarizable marking particles are of different colors.

In accordance with one aspect of the features of the present invention, there is provided an electrophotographic printing machine of the type having a photoconductive member. Means record a latent image on the photoconductive member. Means are provided for developing the latent image recorded on the photoconductive member with charged, insulating marking particles and magnetic, polar or polarizable marking particles.

Pursuant to another aspect of the features of the present invention, there is provided a method of electrophotographic printing including the steps of recording a latent image on the photoconductive member. The latent image recorded on the photoconductive member is developed with charged, insulating marking particles and magnetic, polar or polarizable marking particles.

Other aspects of the present invention will become apparent as the following description proceeds and upon reference to the drawings, in which.

While the present invention will hereinafter be described in conjunction with a preferred embodiment and method of use thereof, it will be understood that it is not intended to limit the invention to that embodiment or method of use. On the contrary, it is intended to cover all alternatives, modifications and equivalents as may be included in the spirit and scope of the invention as defined by the appended claims.

Figure 1:
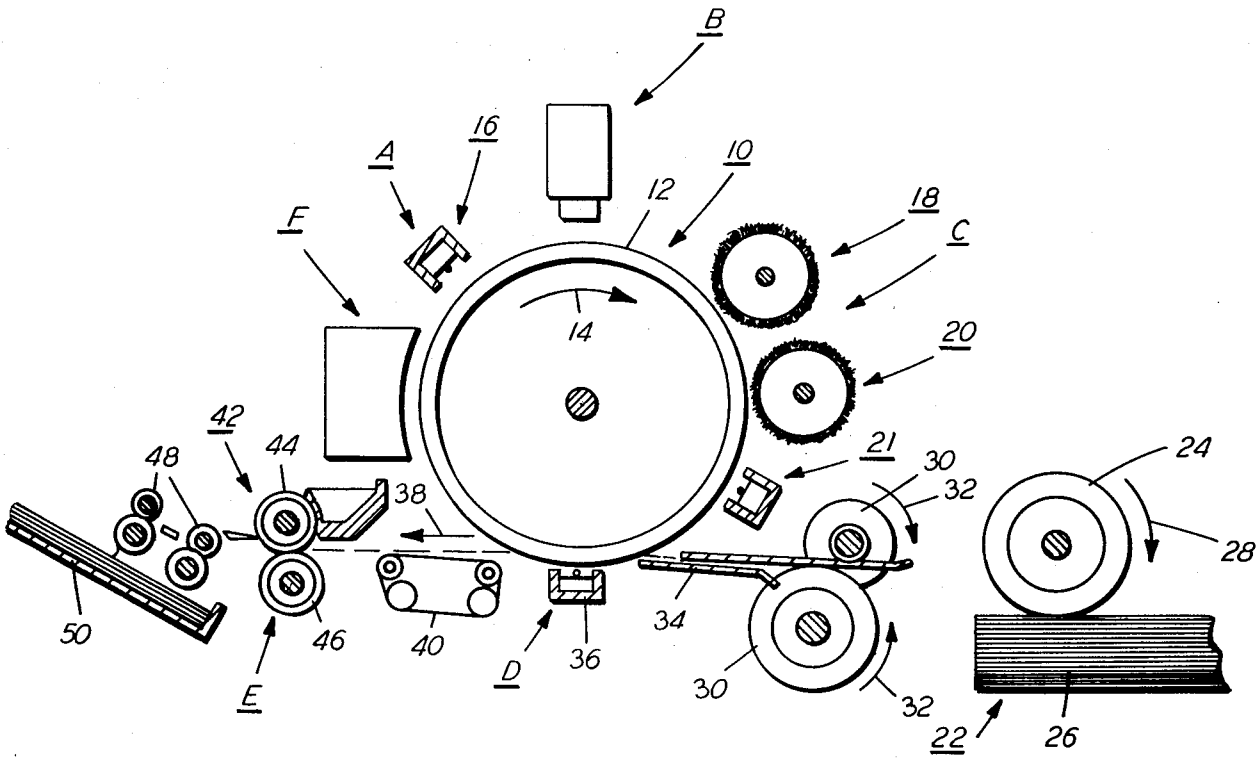
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporting the features of the present invention therein. It will become evident from the following discussion that the apparatus of the present invention is equally well suited for use in a wide variety of electrostatographic printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. By way of example, photoconductive surface 12 is made from a selenium alloy with the conductive substrate being made from aluminum. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B irradiates the charged portion of photoconductive surface 12 to selectively dissipate the charge thereon. The imaging station records a latent image on photoconductive surface 12 and modulates the latent image. Various embodiments of imaging station B and the manner in which the latent image is modulated will be described hereinafter with reference to FIGS. 2 and 3. After the latent image has been recorded on photoconductive surface 12, drum 10 advances the latent image, in the direction of arrow 14, to development station C.

Development station C includes developer rollers 18 and 20. Developer roller 18 transports an insulating developer material into the development zone closely adjacent to the latent image. The developer material comprises carrier granules having toner particles adhering triboelectrically thereto. The toner particles are charged. The latent image attracts a portion of the charged toner particles thereto. The charged toner particles optimumly develop low density lines in the latent image. Developer roller 20 transports magnetic, polar or polarizable marking particles into the development zone closely adjacent to the latent image recorded on photoconductive surface 12. The polar or polarizable marking particles are attracted to the latent image without removing any of the charged toner particles previously deposited thereon. The polar or polarizable marking particles optimumly develop solid areas and halftones. Generally, the polar or polarizable marking particles must, in the presence of a field gradient, become polarized. Where the latent image is modulated, the polar or polarizable particles are attracted thereto because of this characteristic. In this way, halftones and solid areas are optimumly developed. Polar or polarizable marking particles should be of a material having a dielectric constant greater then 2 and a bulk resistivity of at least $10^{11}$ ohm-cm and preferably greater than about $10^{12}$ ohm-cm. Any suitable resinous material having a magnetic core imbedded therein, such as magnetite, having the foregoing characteristics and capable of being fixed to a copy sheet may be employed. For example, magnetite coated with a polyvinyl copolymer such as polyvinylacetate, polyvinylbutyl, and the like; polystyrenes and copolymers thereof; polyolefins, such as polyethylene, polypropylene and the like; acrylates such as polymethylacrylate, polymethylmethylacrylate, polymethylacrylic acid, copolymers thereof and the like; polycarbonates, polyester resins, epoxy resins and the like. The polar or polarizable marking particles may have any suitable shape including spherical, oval, granular, etc. and have a particle size ranging from about 5 to about 50 microns. Preferably, developer roller 20 includes an insulating cyclinder which is rotatable with respect to a cylinder positioned interiorly thereof. The interior cylinder has interdigited electrodes positioned on the surface thereof. A voltage supply electrically biases alternate electrodes in order to establish a suitable voltage different between adjacent electrodes to achieve the desired fields. A suitable voltage ranging from a negative 3000 volts to a positive 3000 volts may be employed. A suitable developer roller is described in greater detail in U.S. Pat. No. 4,289,837 issued to Gundlach on Sept. 15, 1981, the relevant portions thereof being hereby incorporated into the present application.

Developer roller 18 includes a non-magnetic rotating sleeve having a stationary magnet disposed interiorly thereof. The developer roller transports a developer mixture comprising carrier granules having toner particles, triboelectrically charged, adhering to the surface thereof. As the sleeve rotates, the developer mixture of carrier granules and charged toner or marking particles is transported into contact with the latent image recorded on photoconductive surface 12. The charged toner particles are attracted from the carrier granules to the latent image. After the latent image has been developed with both the polar or polarizable marking particles and the charged toner particles, drum 10 advances the resultant powder image thereon to corona generating device 21 which applies a charge opposite in polarity to that of corona generating device 16 onto the powder image. This pre-transfer charge improves transfer efficiency for the polar or polarizable marking particles. Thereafter, the powder image advances to transfer station D.

At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of stack of sheets 26. The feed roll 24 rotates in the direction of arrow 28 to advance the uppermost sheet into a nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 in a timed sequence so that the powder image developed thereon contacts the advancing sheet at transfer station D.

Preferably, transfer station D includes a corona generating device 36 which sprays ions onto the back side of the sheet. This attracts the powder image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred powder image to the sheet. Preferably, fuser assembly 42 includes a heated fuser roller 44 and a back-up roller 46 with the powder image contacting fuser roller 44. In this manner, the powder image is permanently affixed to the sheet. After fusing, forwarding rollers 48 advance the sheet to catch tray 50 for subsequent removal from the printing machine by the operator.

After the particle image is transferred from photoconductive surface 12 to the copy sheet, drum 10 rotates the photoconductive surface to cleaning station F. At cleaning station F, a cleaning brush removes the residual particles adhering to photoconductive surface 12.

It is believed that the foregoing description is sufficient for purposes of the present invention to illustrate the general operation of an electrophotographic printing machine incorporating the features of the present invention therein.

Figure 2:
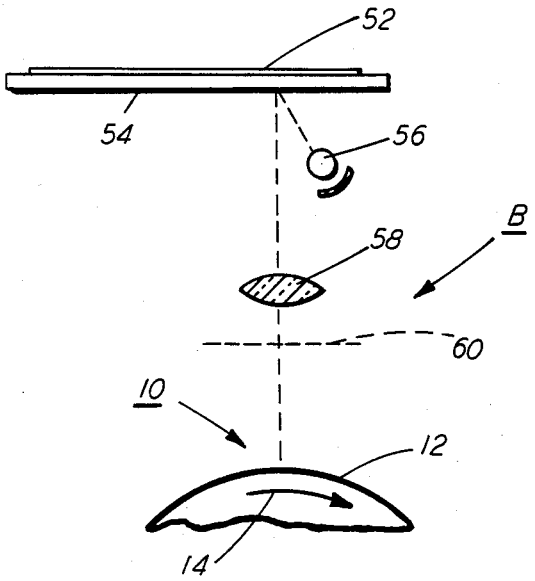
FIG. 2 depicts an optical system used in the FIG. 1 printing machine.

Referring now to FIG. 2, there is shown one embodiment of imaging station B. As depicted thereat, an original document 52 is positioned facedown upon a transparent platen 54. Lamps 56 illuminate the original document with the light rays reflected therefrom being transmitted through lens 58 to form a light image thereof. The light image, in turn, passes through an optical multiplicative halftone screen 60. Screen 60 modulates the light image of the original document passing therethrough. Thus, the electrostatic latent image recorded on photoconductive surface 12 of drum 10 is modulated.

Figure 3:
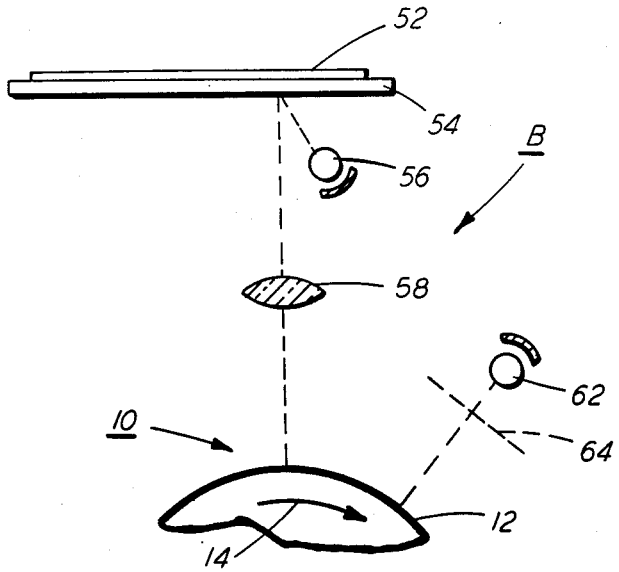
FIG. 3 illustrates another embodiment of an optical system used in the FIG. 1 printing machine.

Turning now to FIG. 3, there is shown another embodiment of imaging station B. In this latter embodiment, an original document 52 is positioned upon a transparent platen 54. Lamps 56 illuminate the original document with the light ray reflected therefrom being transmitted through lens 58 to form a light image thereof. The light image irradiates the charged portion of photoconductive surface 12 of drum 10 to selectively dissipate the charge thereon recording an electrostatic latent image thereon corresponding to the informational areas of original document 52. Thereafter, a lamp 62 transmits light rays through a screen 64 onto the electrostatic latent image recorded on photoconductive surface 12. The modulated light rays illuminate the electrostatic latent image recorded on photoconductive surface 12. Thus, in FIGS. 2 and 3, the imaging station records a modulated electrostatic latent image on the photoconductive surface of drum 10. Thereafter, the modulated electrostatic latent image is developed with an insulating developer material, i.e. developer roller 18 transports the insulating developer material into the development zone, and with magnetic polar or polarizable marking particles, developer roller 20 transports the magnetic polar or polarizable marking particles into the development zone. Moreover, a corona generating device can be interposed between lamps 62 and 56 to charge the photoconductive surface after exposure of original document 52 prior to the modulation thereof. This additional charging step facilitates the development of the latent image with the charged, insulating marking particles and magnetic, polar or polarizable particles in the same area.

One skilled in the art will appreciate that variations of the preceding sequence of operations may be readily employed. An unmodulated electrostatic latent image may be recorded on the photoconductive surface. Thereafter, the unmodulated electrostatic latent image may be developed with the insulating developer material. The resultant developed latent image is then modulated by light rays from a light source passing through an optical screen. After the latent image having the toner particles adhering thereto is modulated, it is developed with the magnetic, polar or polarizable marking particles. In order to perform the foregoing sequence of events, the embodiment of imaging station B depicted in FIG. 3 would be modified such that light source 62 and screen 64 would be interposed between developer rollers 18 and 20 of FIG. 1. Still another variation of the operating sequence may employ a uniform exposure after the unmodulated latent image is developed with the insulating developer material. This uniform exposure discharges the low density information of the latent image. Thereafter, the latent image having the toner particles adhering thereto is exposed to a screened light pattern modulating the latent image. The modulated latent image having the toner particles adhering thereto is subsequently developed with the magnetic polar or polarizable marking particles.

One skilled in the art will also appreciate that a system of this type may be employed to generate two-color information. In order to achieve the foregoing, a negative latent image is recorded on the photoconductive surface corresponding to the colored information contained within the original document. The insulating developer material is advanced into the development zone and colored toner particles deposited on the latent image. Thereafter, a spacially modulated black image is formed on the photoconductive surface. This spacially modulated black image is developed with magnetic polar or polarizable marking particles. In this latter configuration, the polar or polarizable marking particles are black with the toner particles being of the desired color.

In recapitulation, it is evident that the electrophotographic printing machine of the present invention records a latent image on the photoconductive surface which is developed with an insulating developer material and magnetic, polar or polarizable marking particles. The insulating developer material optimumly develops low density lines in the latent image with the polar or polarizable marking particles optimumly developing solid areas or halftones contained therein.

It is, therefore, apparent that there has been provided in accordance with the present invention, an electrophotographic printing machine that fully satisfies the aims and advantages hereinbefore set forth. While this invention has been described in conjunction with specific embodiments and methods of use thereof, it is evident that many alternatives, modifications and variations will be apparent to those skilled in the art. Accordingly, it is intended to cover all such alternatives, modifications and variations as fall within the spirit and broad scope of the appended claims.

We claim:

1. An electrophotographic printing machine of the type having a photoconductive member, including:

means for recording a modulated latent image on the photoconductive member; and means for developing the modulated latent image recorded on the photoconductive member with charged, insulating marking particles and magnetic, polar or polarizable marking particles to form a powder image on the photoconductive member.

2. A printing machine according to claim 1, wherein said recording means includes:

means for forming an unmodulated latent image on the photoconductive member; and means for modulating the unmodulated latent image.

3. A printing machine according to claim 2, further including means for charging the powder image on the photoconductive member.

4. A printing machine according to claim 2, wherein said developing means includes:

first means for transporting the charged, insulating marking particles closely adjacent to the modulated latent image recorded on the photoconductive member; and second means for transporting the magnetic, polar or polarizable marking particles closely adjacent to the modulated latent image recorded on the photoconductive member.

5. A printing machine according to claim 2, wherein said forming means includes:

means for charging the surface of the photoconductive member to a substantially uniform level; and means for selectively illuminating the charged portion of the surface of the photoconductive member to record the unmodulated latent image thereon.

6. A printing machine according to claim 5, wherein said modulating means includes:

a light source arranged to transmit light rays onto the unmodulated latent image; and a screen positioned in the path of the light rays being transmitted onto the unmodulated latent image to modulate the light rays being tranmitted thereto.

7. A method of electrophotographic printing, including the steps of:

recording a modulated latent image on the photoconductive member; and developing the modulated latent image recorded on the photoconductive member with charged, insulating marking particles and magnetic, polar or polarizable marking particles to form a powder image on the photoconductive member.

8. A method of printing according to claim 7, wherein said step of recording includes the steps of:

forming an unmodulated latent image on the photoconductive member; and modulating the unmodulated latent image.

9. A method of printing according to claim 8, further including the step of charging the powder image on the photoconductive member.

10. A method of printing according to claim 8, wherein said step of developing includes the steps of:

transporting the charged, insulating marking particles closely adjacent to the modulated latent image recorded on the photoconductive member; and advancing the magnetic, polar or polarizable marking particles closely adjacent to the modulated latent image recorded on the photoconductive member.

11. A method of printing according to claim 8, wherein said step of forming includes the steps of:

charging the surface of the photoconductive member to a substantially uniform level; and illuminating selectively the charged portion of the surface of the photoconductive member to record the unmodulated latent image thereon.

12. A method of printing according to claim 11, wherein said step of modulating includes the steps of:

transmitting light rays onto the unmodulated latent image; and positioning a screen in the path of the light rays being transmitted onto the unmodulated latent image to modulate the light rays being transmitted thereto.

* * * * *